US005327629A

United States Patent [19]

Coon et al.

[11] Patent Number: 5,327,629

[45] Date of Patent: Jul. 12, 1994

[54] INVERTING SEAT COVERS

[75] Inventors: Gerald A. Coon, Cridersville; Douglas A. Reinhart, Tiffin; Lawrence D. Ray, North Baltimore, all of Ohio

[73] Assignee: Findlay Industries, Findlay, Ohio

[21] Appl. No.: 88,730

[22] Filed: Jul. 9, 1993

Related U.S. Application Data

[60] Division of Ser. No. 951,912, Sep. 28, 1992, Pat. No. 5,253,401, which is a continuation-in-part of Ser. No. 791,020, Nov. 12, 1991, Pat. No. 5,180,460.

[51] Int. Cl.[5] ..... B68G 7/05

[52] U.S. Cl. ..... 29/91; 29/91.1; 29/235; 29/281.4

[58] Field of Search ..... 29/91, 91.1, 91.7, 91.8, 29/235, 251, 281.1, 281.4, 91.5; 53/115, 120, 429, 459, 570, 776; 5/489, 490, 491; 156/91, 93, 212, 213, 297, 299; 264/339; 223/39; 297/DIG. 1

[56] References Cited

U.S. PATENT DOCUMENTS

| | | | |
|---|---|---|---|
| 3,103,302 | 9/1963 | Minton | 223/39 |
| 3,125,261 | 3/1964 | Arbter | 223/39 |
| 3,310,207 | 3/1967 | Gore | 223/39 |
| 4,249,972 | 2/1981 | Barth | 223/39 X |
| 4,385,427 | 5/1983 | Fraiser | 29/91.5 |
| 4,675,962 | 6/1987 | Tillner et al. | 29/91.1 |
| 4,739,910 | 4/1988 | Westphal et al. | 223/39 X |
| 4,740,260 | 4/1988 | Selbert et al. | 156/213 |
| 5,199,144 | 4/1993 | Abe et al. | 29/281.4 X |

FOREIGN PATENT DOCUMENTS

| | | | |
|---|---|---|---|
| 2151966 | 11/1972 | Fed. Rep. of Germany | 29/91.1 |

*Primary Examiner*—Peter Dungba Vo
*Attorney, Agent, or Firm*—Sidney W. Millard

[57] ABSTRACT

Seat covers are sewn inside-out and then inverted to fit over a frame. Inversion is accomplished by threading the sewn seat cover over a pair of generally parallel arms. The sewn seat cover is generally in the form of a pocket. The closed end of the pocket is engaged by the blunt edge of a plate. The plate pushes the closed end between the arms forcing the structure of the pocket to ride up and over the top of the arms and downward between the two arms thereby inverting the seat cover to a right side out condition.

8 Claims, 8 Drawing Sheets

INVERTING SEAT COVERS

This application is a divisional application of co-pending application Ser. No. 07/951,912, filed Sep. 28, 1992, now U.S. Pat. No. 5,253,401 which is a continuation-in-part application of co-pending application Ser. No. 791,020, filed Nov. 12, 1991, now U.S. Pat. No. 5,180,460.

FIELD OF THE INVENTION

This invention relates to a method and apparatus for inverting a seat cover which is sewn together in inside-out condition.

BACKGROUND OF THE INVENTION

Modern motorized vehicle seats have a wear surface of fabric, leather, or the like consisting of a plurality of panels of material sewn together in conventional construction. The sewn edges of the panels are hidden from view of the user of the seat, but the sewing process itself is accomplished by conventional commercial grade sewing machines which sew all of the seat cover parts together with the sewing taking place while the wear surface of the seat cover is in inverted condition. After sewing, the seat cover has front and back panels joined together along three sides with the fourth side open to slide over the frame. The sewn panels form a pocket-like structure. The seat cover as sewn must be inverted to get the wear surface to the exterior of the pocket formed in the sewing operation.

It is conventional to sew, adhesively bond, or otherwise secure foam rubber padding, etc. to the front panel of the seat cover prior to the time the front and back panels are sewn together. The padding is to provide comfort for the user of the seat. A problem is created by the fact that the padding is secured to the front panel of the seat cover, in that, the volume of the padding bulges into the pocket making a tight fit and making it physically difficult to invert the seat cover to operative position. Heretofore, in this industry the inversion has taken place by a hand operation which is time consuming, physically exhausting, an altogether labor intensive feature of the manufacturing process.

A review of product inverting apparatus has been made and U.S. Pat. No. 4,249,972 is illustrative. It shows apparatus for inverting inside-out girdles using two upstanding arms over which the girdle is threaded. A plate descends downward between two upstanding arms and pushes the closed end of the girdle downward between the two arms to invert the girdle structure.

U.S. Pat. No. 3,125,261 shows similar structure to that of the patent mentioned above except that the structure reciprocates in horizontal fashion rather than vertical fashion.

In U.S. Pat. No. 4,739,910 an apparatus and method are shown for inverting a pair of training pants for children. It uses a cone-shaped structure over which the training pants are fitted and a probe which pushes within the cone-shaped structure from the narrowest end to invert the training pants as the probe pushes to the interior of the cone.

U.S. Pat. No. 3,310,207 shows apparatus for inverting a pillowcase which includes a couple of arms which project to the closed end of the pillowcase and then some mechanism grasps the collar at the open end and pulls it longitudinally toward the closed end.

U.S. Pat. No. 3,103,302 shows an apparatus for inverting hosiery which uses a piston and cylinder combination actuated by a foot peddle to assist in the inversion process.

As a result of the problem in the industry and the research performed in seeking a solution, it was concluded that new and original apparatus was required to accomplish the desired result.

SUMMARY OF THE INVENTION

The resulting framework is designed to hold the working parts of the apparatus at the most convenient working level for the operator of the equipment. The framework is supported on some substrate and includes a pair of loosely mounted, generally parallel, upwardly extending arms. The arms can flop back and forth in a defined, but relatively small angle, to facilitate the easy threading of the sewn seat cover over the free ends of the arms, whereby, the closed end of the pocket formed by the seat cover is at the upper or free end of the arms. The arms may be rigid if desired.

The framework includes a mast extending upwardly to support and guide a plate in its reciprocation from a location upwardly displaced from the arms and a second position intermediate the two arms. The plate reciprocates between the extreme positions in response to an air actuated piston and cylinder combination and the plate is guided in its traverse between the two extremes by the mast.

A seat cover, already sewn and in inverted condition, is threaded over the two arms and the air cylinder is actuated to drive the plate downward into the closed end of the pocket at the top of the two arms and push it downward between the two arms to invert the pocket structure of the seat cover and turn it right side out. After the descent of the plate between the two arms has reached its lower most position, the air is released and the piston and cylinder combination reverse the movement of the plate and they lift the plate and enveloping seat cover to a position vertically upward of the two arms. Subsequently the seat cover may be easily striped by hand from the plate.

An alternative embodiment substitutes (1) a cage for the upwardly extending arms and (2) a ball shape at the lower end of the hydraulic piston for the plate. The cage comprises a plurality of bars forming an enclosure topped by an oval opening. The seat cover is pulled over the cage and the ball descends through the oval opening to push the seat cover into the cage. As the seat cover slides up the exterior of the cage to follow the ball through the oval opening it is inverted. Upon withdrawal of the ball from the cage, a border frame circumscribing the oval opening restrains the inverted seat cover to automatically strip it from the ball.

Objects of the invention not understood from the above will be clear upon a review of the drawings and the description of the preferred embodiment.

BRIEF DESCRIPTION OF THE DRAWINGS

For the purpose of illustrating the invention, there are shown in the drawings forms which are presently preferred. It is understood that this invention is not limited to the precise arrangements and instrumentalities shown.

DESCRIPTION OF THE PREFERRED EMBODIMENT

Figure 1:
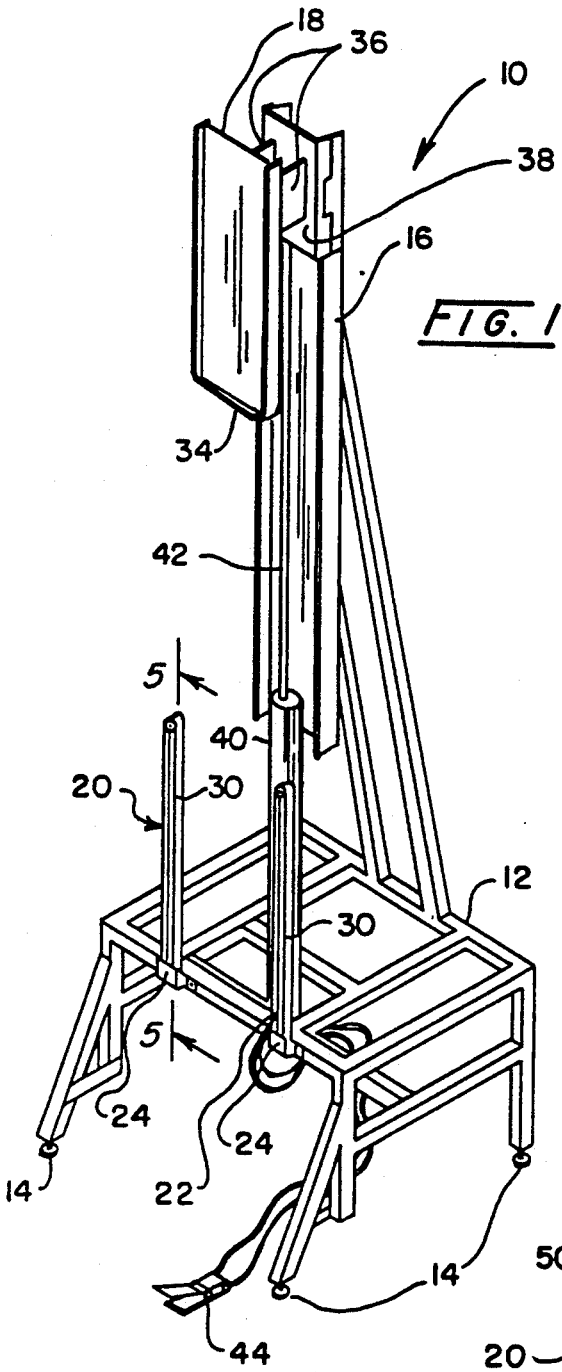
FIG. 1 is a perspective view of the inverting apparatus of this invention.

FIGS. 1–4 illustrate the apparatus of this invention in an operative sequence, The apparatus 10 is designed to invert sewn seat covers which are sewn in inverted condition for purposes of hiding the stitching of the seams from the observer and to minimize wear on the threads of the sewing material during normal usage, The apparatus is mounted on a framework 12 formed of a plurality of square or U-shaped channels welded or bolted together to form a stable structure which may be supported on any suitable substrate, Foot pads 14 may be adjusted in conventional fashion to level the framework on the substrate.

A mast 16 projects upwardly from the framework to support and guide vertical reciprocation of a plate 18 which will be explained in more detail subsequently.

Toward the front of the inverting apparatus, where the worker will perform, and as shown in FIGS. 1–4, are a pair of upwardly projecting rods or arms 20, 22. One end of each arm is loosely secured to frame 12 by a U-shaped clamp 24 which is bolted to the frame.

Figure 5:
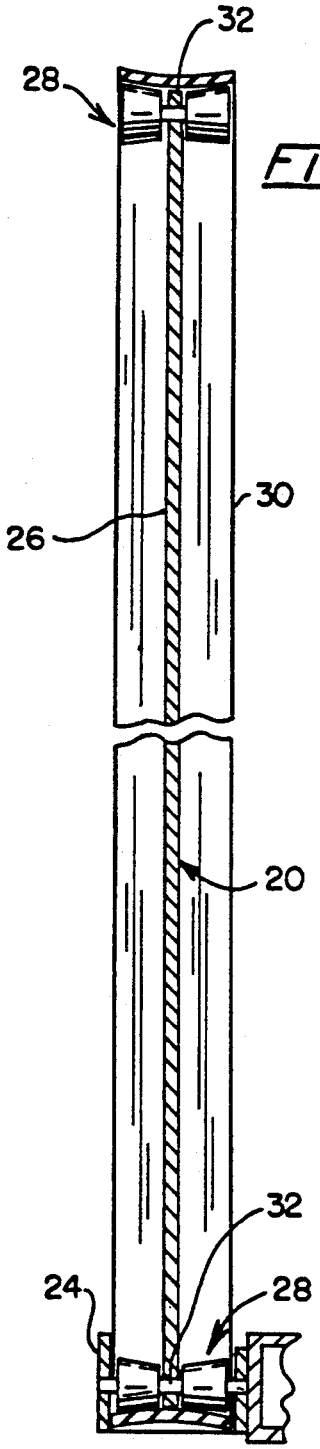
FIG. 5 is a fragmentary sectional view taken along line 5—5 of FIG. 1.
Figure 6:
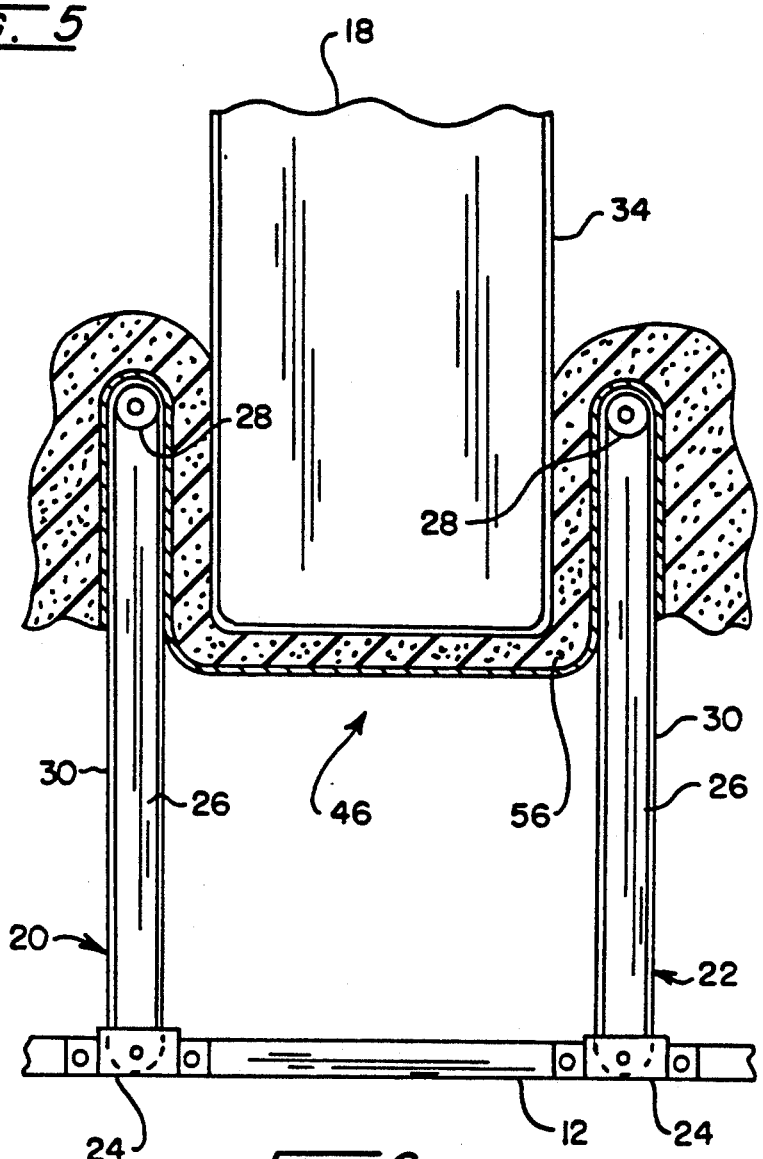
FIG. 6 is a fragmentary sectional view taken along line 6—6 of FIG. 3.

As best seen in FIGS. 5 and 6, each arm includes a metallic strut 26 projecting from one end of the arm to the other and which may be of any particular geometric shape as needed to provide dimensional stability and strength. At each end of the strut 26 is a roller structure 28 which supports an endless belt 30. Each belt 30 extends completely around the exterior of its associated arm 20, 22. The roller structure 28 is illustrated as a pair of rollers, frusto-conical in shape, with each frustum converging toward the center of the arm. In this fashion the belt 30 is biased to track the route around the arm and maintain alignment on the rollers. Each set of frusto-conical rollers is mounted on an axle 32 having an axis, and the axis of each axle is parallel with the axis of the other axles of the other roller structures.

Note that the mounting structure as illustrated in FIGS. 5 and 6 which secures the arm 20, 22 to the frame 12 is loosely secured to the frame so that the arm may flop back and forth in a limited arc in a vertical plane for reasons which will be explained in more detail subsequently.

Looking again to FIGS. 1 and 6, plate 18 is bordered on three sides by a blunt edge 34 which curves in a generally U-shaped pattern around the bottom side and the two side edges. The blunt edge 34 is generally wider than the plate 18 and curves at the corners to have a smooth surface at that point without sharp edges. Plate 18 is mounted on a pair of brackets 36 secured to a mounting plate 38 of a generally U-shaped configuration. Conventional guide structure associated with plate 38 and mast 16 allow vertical reciprocation and guiding of the plate 18 in response to air actuated operation by a piston and cylinder combination 40. The mounting plate is structurally attached to piston rod 42 projecting from the cylinder, best seen in FIGS. 1 and 2, and reciprocates with the rod in response to the piston and cylinder combination. Actuation of the piston and cylinder combination is by a foot peddle 44 where the worker may step on the peddle to cause plate 18 to descend. Release of the peddle causes the plate to ascend back to its upper original position as illustrated in FIG. 1.

Figure 2:
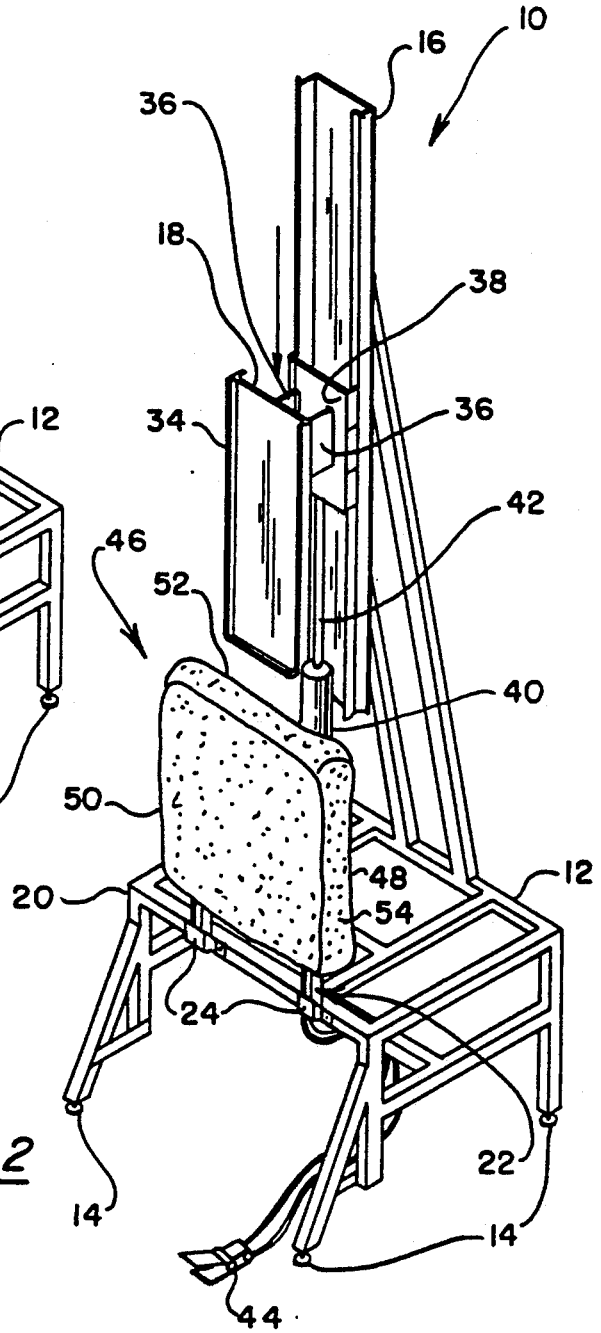
FIG. 2 is a perspective view of the apparatus of this invention with a seat cover in position to be inverted and with the inverting plate partially descended in operative sequence.
Figure 4:
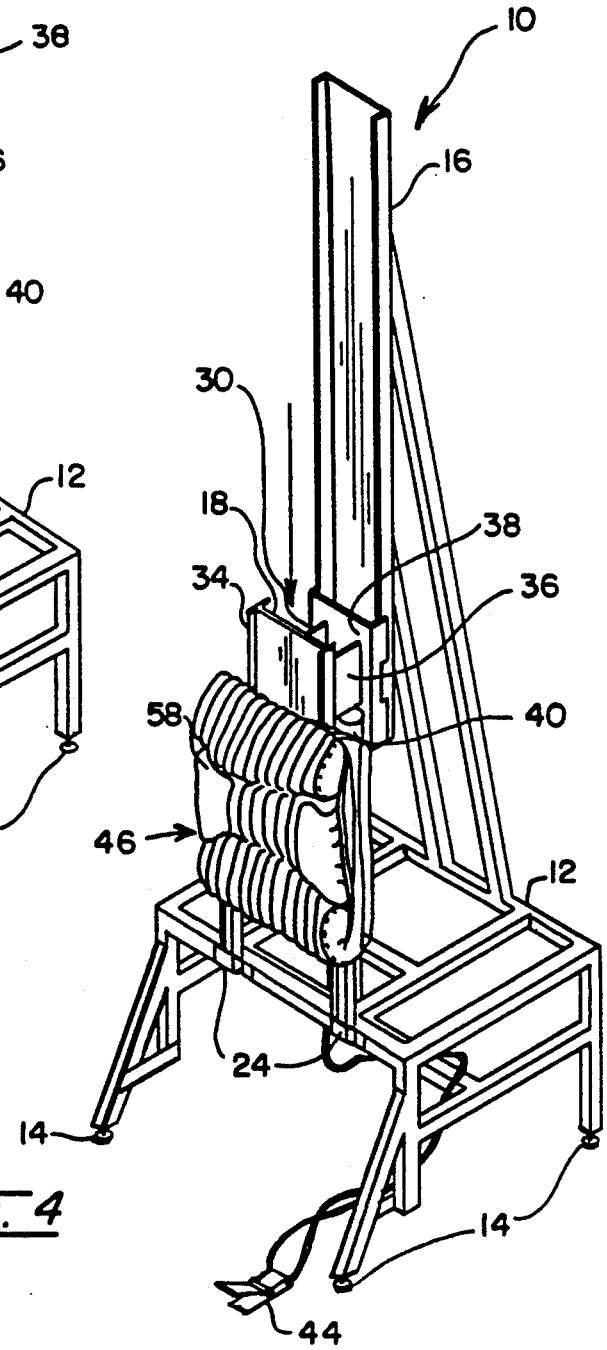
FIG. 4 is a perspective view of the apparatus of this invention with the inverting plate completely depressed to its lower position and the seat cover having been completely inverted.

FIG. 2 illustrates a sewn seat cover 46 in inverted condition threaded over the top of the two arms 20 and 22. FIG. 4 illustrates the appearance of the same seat cover after it has been inverted by the apparatus of this invention with its decorative wear surface exposed to the vision of a user.

In operation, a seat cover 46 is sewn together as a series of panels for the desired decorative appearance of the seat in final condition with the sewn seams in a position such that they will be hidden from the view of an observer after the seat cover is inverted into operative position. There may be a back panel 48, a front panel 50, a top panel 52, and side panels 54.

In any case, the front panel 50 is joined to the back panel 48 to form a pocket with the top panel 52 and side panels 54 forming closed sides of the pocket and with the downwardly facing surface as illustrated in FIG. 2 forming an opening into the pocket, which opening is threaded over the tops of the two upwardly extending arms 20 and 22. The worker steps on peddle 54 which actuates the piston and cylinder combination 40. Piston rod 42 draws mounting plate 38 and inverting plate 18 downward such that the blunt edge 34 engages top panel 52 of the seat cover. The wide rounded surface of the blunt edge 34 is configured to engage the top panel 52 to force it downwardly between the two arms to invert the seat, but without being so sharp as to cut, puncture, or abrade the panel 52 during its engagement.

FIGS. 1–4 show the basic procedural sequence of this invention. FIG. 1 shows the apparatus before the procedural sequence begins with the inverting plate 18 at its uppermost position and arms 20 and 22 projecting upwardly waiting to have an inside-out seat cover 46 threaded over their tops as illustrated in FIG. 2. The loose mounting arrangement 24 allows arms 20, 22 to incline inwardly toward each other to facilitate their manual insertion into the open end of the inverted seat cover. After the worker actuates the piston and cylinder combination 40 by stepping on foot peddle 44, the plate begins to descend and FIG. 2 illustrates the descending plate just before it engages top panel 52 of the seat cover.

Figure 3:
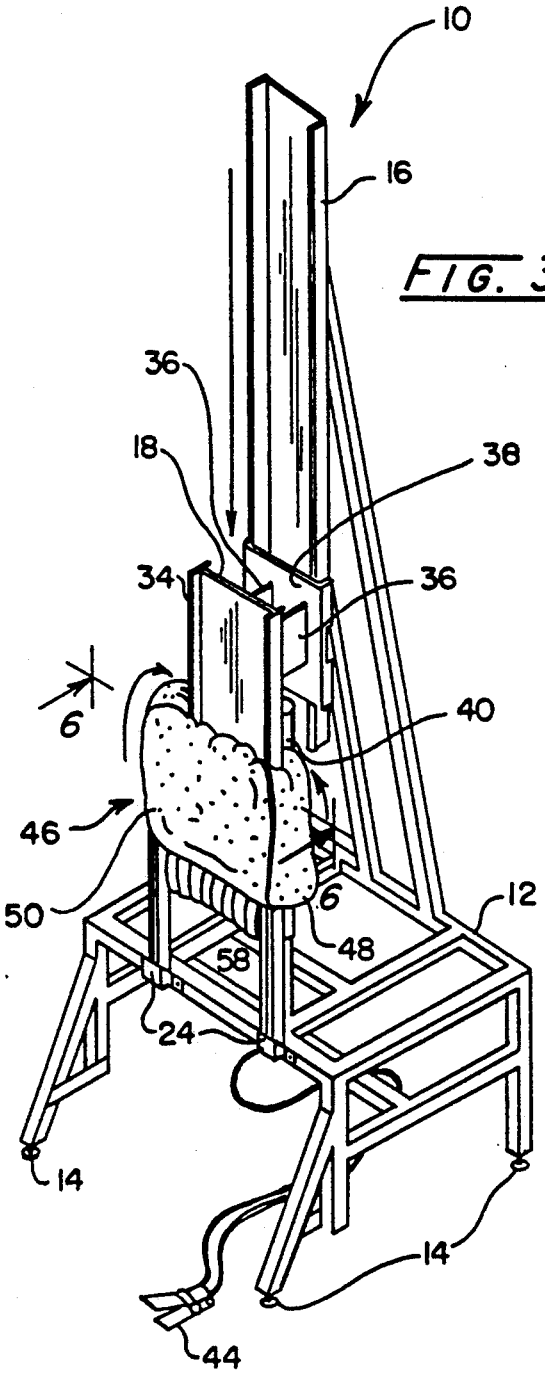
FIG. 3 is a perspective view of the apparatus of this invention similar to FIG. 2 except that the inverting plate is shown in engagement with the seat cover having partially inverted the same.

FIGS. 3 and 6 may be viewed together to show the seat partially inverted as the plate 18 continues it descent. The sloppy fit or loose connection of the arms 20, 22 to frame 12 not only allows the easy threading of the seat cover over their tops, but also serves to self-align the two arms with plate 18 as it passes intermediate the arms in its descent. Together the two arms 20, 22 form a cage around plate 18 as it descends. The pull of the seat cover on the top of the arms as the plate 18 forces its way between the two arms aligns the two arms parallel with the sides of the plate 18 as the belt rolls upward with the surface of the seat cover as the plate 18 pushes it downward between the two arms. It will be observed in FIG. 5 that no part of the arms 20 or 22 extends beyond the edge of the belt 30 and the reason for that is to prevent any abrasions or snags of the wear surface of the seat cover as it rides upwardly on the outer surface of the belt 30 over the top of the roller structure 28 and down the inside surface of belt 30, all without touching any relatively moving part of the arm. The belt moves with the surface with which it is in contact and so no abrasions can occur. Roller structure in combination with the endless belts serves to minimize friction because no part of the seat cover 46 ever engages a surface which moves relative to its contact surface, including the initial manual threading of the pocket over the arms 20, 22.

Looking to FIG. 6, it will be observed that the padding 56 forms a layer between the referred to panels 48, 50, 52, 54 of FIG. 2 and the decorative or wear surface of the seat cover, for convenience only decorative front surface 58 is numbered. The majority of the internal volume of the pocket formed by the seat as illustrated in FIG. 2 is taken up by the foam rubber or other kind of padding 56 in the illustrated condition and that is why it is so physically difficult to invert the seat cover. Upon the inversion, as shown in FIG. 4, the inverted seat has enveloped the lower portion of the plate 18 and upon release of the foot peddle 44 the plate 18 retracts to its original position as illustrated in FIG. 1 and the worker may easily strip the inverted seat cover from plate 18 and begin the process again.

Note that the blunt edge or surface 34 extends along plate 18 a distance greater than the length of the seat cover 46. This feature ensures that no sharp edge on plate 18 will snag the seat lining when the worker strips the inverted seat cover from plate 18.

Figure 7:
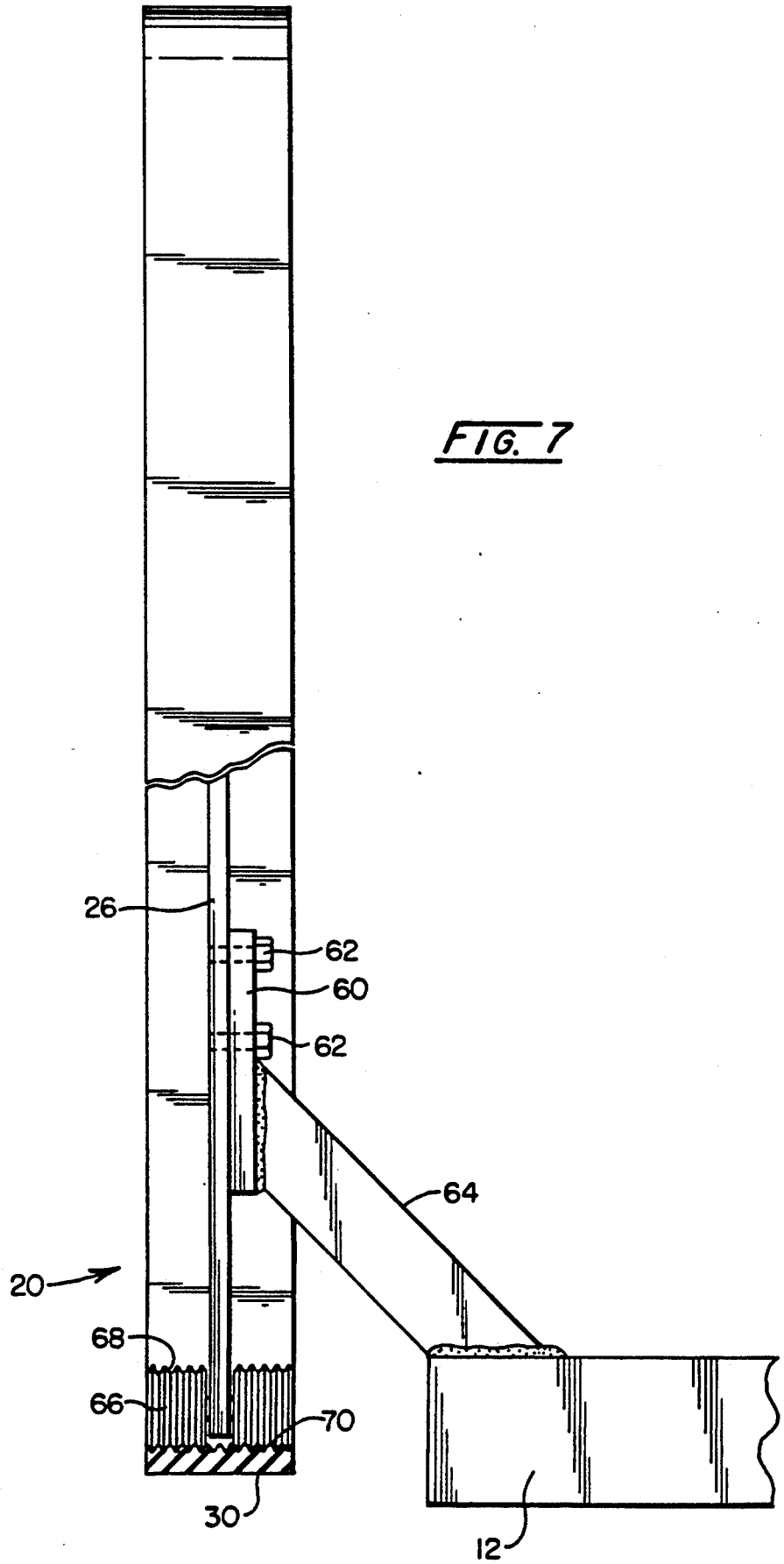
FIG. 7 is a fragmentary sectional view of an alternative embodiment of the upstanding arm of FIG. 5.
Figure 8:
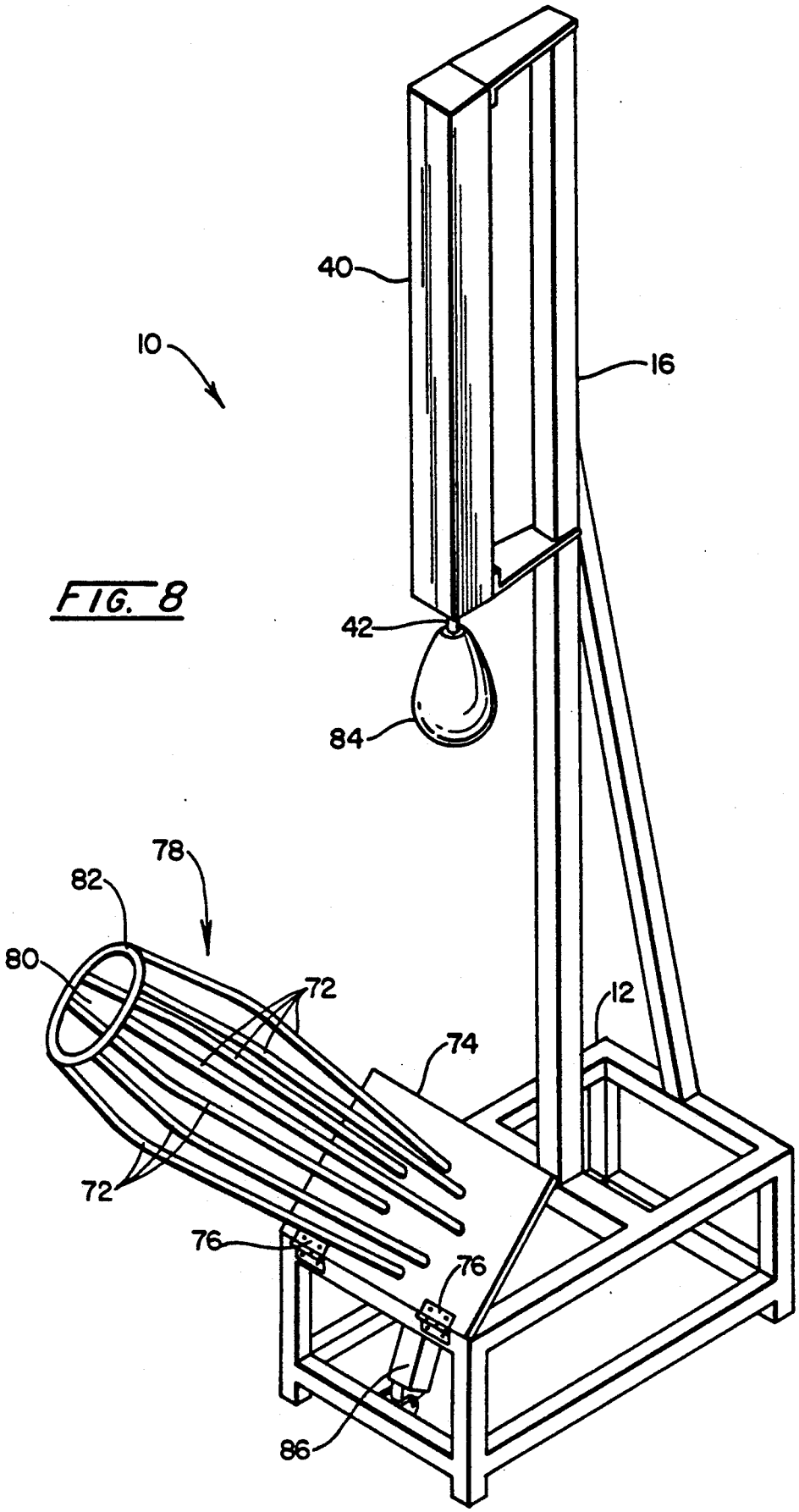
FIG. 8 is another alternative embodiment shown in perspective.
Figure 9:
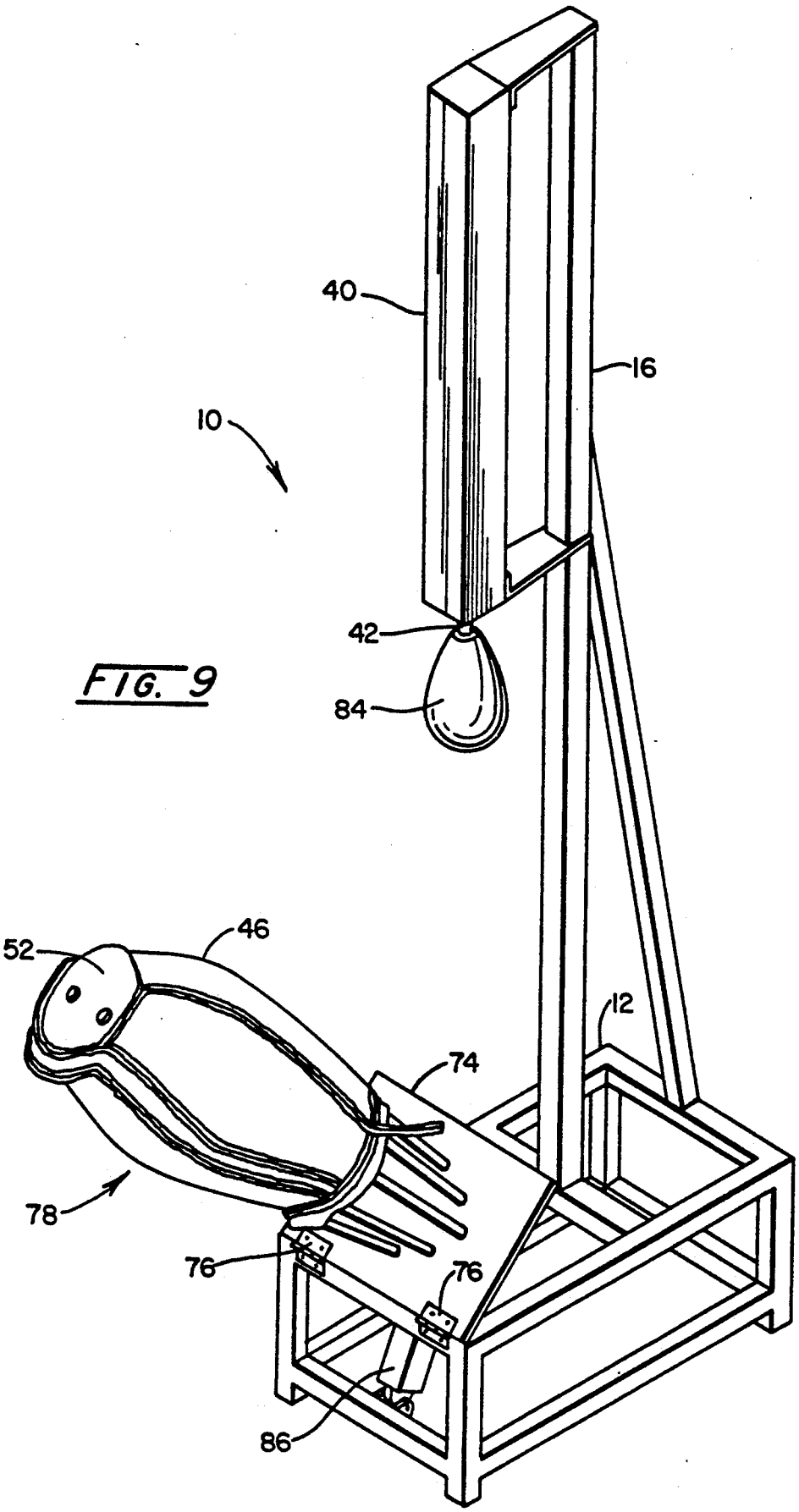
FIG. 9 is a respective view of the embodiment of FIG. 8 with a seat cover slipped over the inverting cage.
Figure 10:
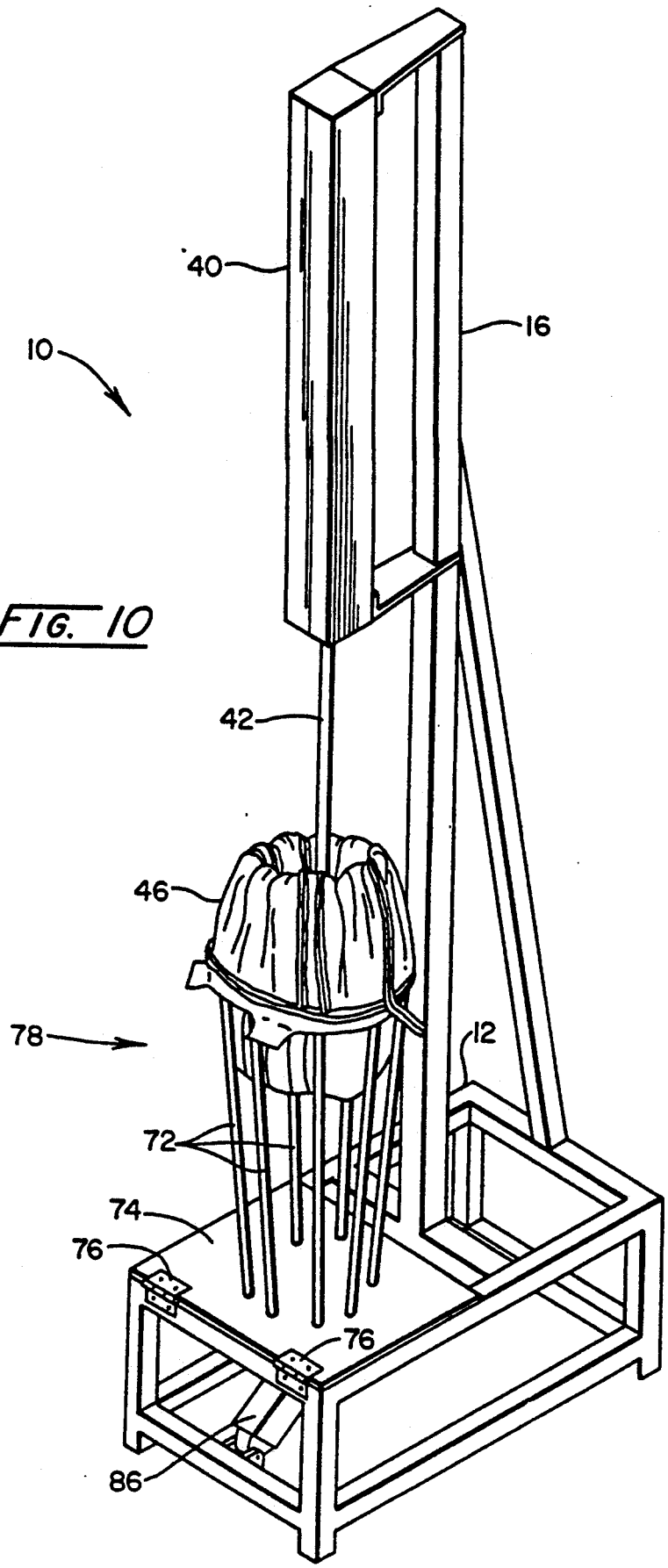
FIG. 10 is a perspective view of the embodiment of FIG. 8 with the apparatus in operative position and the seat cover partially inverted.
Figure 11:
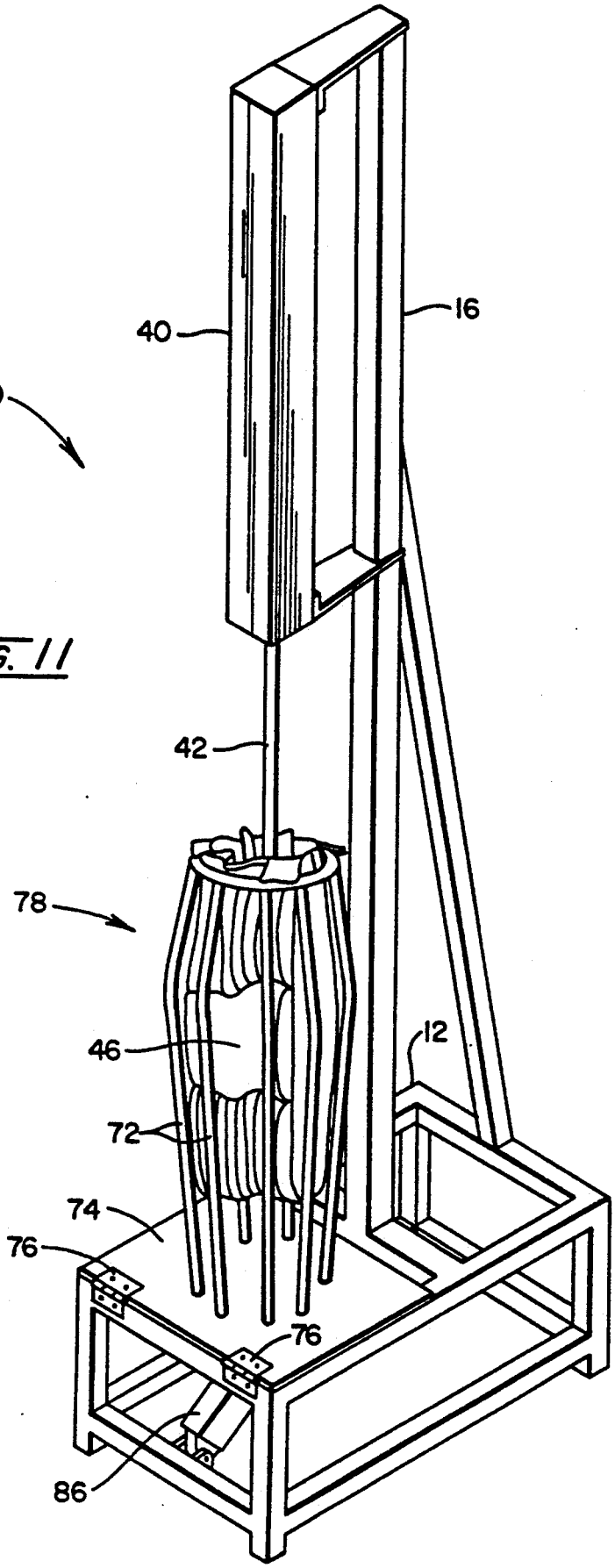
FIG. 11 is a perspective view similar to FIG. 10 with the seat cover completely inverted.

FIG. 7 illustrates an alternative embodiment to FIG. 5, the arm 20 may be supported on a bracket 60 which is secured to strut 26 by bolts 62. The resulting rigid connection precludes play of the upper ends of arms 20, 22 as allowed by the embodiment of FIG. 5.

Bracket 60 is secured to frame 12 by a support bar 64. The ends of support bar 64 are illustrated as being welded to frame 12 and bracket 60.

To keep the belt 30 aligned on arm 20 in the FIG. 7 embodiment the rollers 66 are grooved at 68 to receive internally projecting ribs 70 on the belt. Belt aligning structure as illustrated in FIGS. 5 and 7 may be used satisfactorily as may other structures. It should be noted that the seat cover 46 will not extend downwardly so as to engage bar 64, accordingly strut 26 may be a little longer in FIG. 7 than in FIG. 5.

FIGS. 8–11 illustrate another alternative embodiment wherein the upwardly extending arms of FIGS. 1–7 comprise a plurality of smooth rods 72 extending upwardly from base plate 74. Plate 74 is hinged at 76 to said frame to allow base plate 74 to tilt forwardly toward the operator of the apparatus. The angular tilt illustrated in FIG. 8 facilitates work of the operator in threading the sown seat cover over the cage 78 formed by rods 72.

Note that the cage 78 is somewhat bell shaped and terminates in an oval aperture 80 at its upper end, which aperture is circumscribed by a border frame 82.

Piston and cylinder combination 40 are inverted in FIGS. 8–11 whereby the piston rod 42 moves downward in its inverting operation. The inverting structure comprises a smooth or padded ball 84 as a substitute for plate 18 with the blunt edge 34 of FIGS. 1–7. Ball 84 is secured to the lower end of piston rod 42. Ball 84 engages end panel 52 in its downward movement, see FIGS. 10 and 11, and drags the seat cover into the cage 78 through aperture 80 until the seat cover is right side out. Subsequently, piston rod 42 is retracted and oval border frame 82 strips the seat cover from ball 84 for easy recovery by the operator. Blunt edge 34 and ball 84 both provide a smooth contact surface to prevent cutting or abrading panel 52.

In operation seat cover 46 is inside out after it is sown. In that condition it is slipped over cage 78 with its closed end panel 52 roughly centered over aperture 80. Actuation of the inverting aperture is illustrated as a foot peddle 86. The actuating device could be a lever, button or other device if preferred.

Actuation causes base plate 74 and cage 78 to pivot on hinges 76 to align aperture 80 with piston rod 42. When alignment is accomplished, piston and cylinder combination 40 is actuated to drive rod 42 and ball 84 downward to engage end panel 52 and drive seat cover 46 into cage 78 through aperture 80. As ball 84 pushes panel 52 downward seat cover 46 slides up the smooth surface of bars 72 until it is completely inserted and surrounds ball 84 and the piston rod 42.

Upon completion of the downward stroke the rod 42 retracts. Because of the bell shape of cage 78 and the reduced size of the aperture 80 formed by the border frame 82, the inverted seat cover is stripped from ball 84 to remain in cage 78 where it is easily recovered by the operator when support or plate 74 tilts forward again at the end of the cycle.

Having thus described the invention in its preferred embodiment, it will be clear to those having ordinary skill in the art that modifications may be made in the apparatus without departing from the spirit of the invention. Accordingly, it is not intended that the drawings, nor the language used herein to describe the invention, be limiting on the invention itself, rather it is intended that the invention be limited only by the scope of the appended claims.

We claim:

1. Apparatus for inverting a seat cover which has been sown inside out comprising, a frame having a piston and cylinder combination mounted thereon, a piston rod extending from said piston, an inverting device secured to one end of the piston rod remote from said piston, means forming a cage to surround said inverting device when said inverting device has inverted said seat cover, a mast secured to said frame, said mast including means holding said piston and cylinder combination with said piston rod in alignment with an aperture opening of said cage, said cage being formed of at least three rods, said rods having similar shape and two ends, said rods being secured to said frame at one ends thereby defining a securing location and extending from said frame toward said inverting device and defining said aperture opening of said cage at the other ends remote to said one ends of said rods, and means for reciprocating said inverting device from a position remote from said cage in an aligned path through said aperture into said cage to a location near the securing location where said rods are secured to said frame.

2. The apparatus of claim 1 wherein said rods are secured to said frame in a generally circular pattern, each rod extends toward said inverting device and terminates at a frame border defining said aperture.

3. The apparatus of claim 2 wherein said rods bow outward from the aligned path of said inverting means intermediate said frame border and where said rods are secured to said frame.

4. The apparatus of claim 3 wherein said inverting device comprises a ball shape having a diameter smaller than said aperture.

5. The apparatus of claim 2 wherein said inverting device comprises a ball shape having a diameter smaller than said aperture.

6. The apparatus of claim 1 wherein said inverting device comprises a ball shape having a diameter smaller than said aperture.

7. The apparatus of claim 1 wherein said cage further comprises a pair of aligned rods spaced apart by a dimension greater than the greatest transverse dimension of said inverting means, said transverse dimension being measured perpendicular to said path.

8. The apparatus of claim 1 wherein said cage is mounted on a base plate hinged to said frame and tiltable toward the operator of said apparatus and out of alignment with said inverting means.

* * * * *